US006084518A

United States Patent [19]

Jamieson

[11] Patent Number: 6,084,518

[45] Date of Patent: Jul. 4, 2000

[54] BALANCED CHARGE FLAME CHARACTERIZATION SYSTEM AND METHOD

[75] Inventor: Jerel S. Jamieson, Waukesha, Wis.

[73] Assignee: Johnson Controls Technology Company, Plymouth, Mich.

[21] Appl. No.: 09/337,018

[22] Filed: Jun. 21, 1999

[51] Int. Cl.[7] ..... G08B 17/12

[52] U.S. Cl. ..... 340/577; 340/579; 341/66

[58] Field of Search ..... 340/577, 578, 340/579; 341/13, 25, 66, 72, 75, 78; 324/71.1, 464, 693, 713

[56] References Cited

U.S. PATENT DOCUMENTS

| | | | |
|---|---|---|---|
| 4,034,235 | 7/1977 | Wade | 340/577 |
| 4,157,506 | 6/1979 | Spencer | 340/577 |
| 4,410,266 | 10/1983 | Seider | 431/79 |
| 4,709,190 | 11/1987 | Allington | 315/30 |
| 4,871,307 | 10/1989 | Harris et al. | 340/579 |
| 5,209,655 | 5/1993 | Geary | 341/6 |
| 5,348,466 | 9/1994 | Momber | 431/6 |
| 5,577,905 | 11/1996 | Momber et al. | 431/66 |
| 5,698,952 | 12/1997 | Stebbins | 315/307 |

*Primary Examiner*—Daniel J. Wu
*Assistant Examiner*—Van T. Trieu
*Attorney, Agent, or Firm*—Quarles & Brady LLP; George E. Haas

[57] ABSTRACT

A sensor for detecting characteristics of a flame includes a pair of electrodes that are spaced apart for passing an electric current through the flame. A pulse width modulator is coupled to the electrodes and generates an alternating current which flows through the flame. A controller operates the pulse width modulator to alter the duty cycle of the alternating current so that the average current through the flame is zero. Flame characteristic information is derived from the lengths of the positive and negative periods of the resultant alternating current.

11 Claims, 2 Drawing Sheets

BALANCED CHARGE FLAME CHARACTERIZATION SYSTEM AND METHOD

BACKGROUND OF THE INVENTION

The present invention relates to apparatus and techniques for determining the physical characteristics of a flame, such as in furnaces and boilers, and more particularly to apparatus and techniques for determining electrical characteristics of a flame.

The flow of gas to a burner often is controlled by a system which includes a device that senses the flame. In many situations the mere presence of the flame is all that is important and industry standards define the physical flame characteristics that can be used for safety control. In other instances, such as relatively large burners, the flame characteristics are sensed in order to optimize burner efficiency and minimize the production of undesirable pollutants. For these latter purposes, costly optical sensing systems often are employed which are impractical on smaller burner systems, such as found in residential furnaces and boilers.

In such smaller control systems, it is more cost effective to use the rectification characteristic of a metal sensor rod 12 embedded in the flame 11 as shown in FIG. 1. An alternating voltage is applied between the rod and the burner 14, which is usually at earth ground potential. The rod and burner form a pair of electrodes between which an alternating electric current flows through the flame. The resultant current is related to the physical geometry of the rod/flame/burner system and the chemistry of the flame. It is important to note that in these systems there is no direct temperature measurement involved.

The current path through the flame 11 can be modeled as a pair of oppositely poled resistive diodes 15 and 16. In a typical application of this rectification characteristic, the higher current flow path is represented by the diode 15 pointing toward the burner 14 with the resistance referred to as the forward resistance ($R_f$). Current flow through diode 16 from the burner 14 to the sensor rod 12 encounters a resistance that is referred to as the reverse resistance ($R_r$) Conventional furnace controls take advantage of the fact that there is a differential diode characteristic that indicates the presence of a flame. This characteristic is unlikely to be falsely generated by contamination or other effects as could occur with a simple direct current resistance measurement.

Because the proof of the presence of a flame 11 is at issue, a typical control technique applies a symmetrical alternating current waveform (typically a sine wave derived from the power line) to the sensor rod 12 embedded in the flame. The control circuit averages the forward and reverse currents in an RC circuit and uses a derived non-zero DC signal to indicate the presence of the current path and thus the flame that provides that path. This means that the only information available is the difference between the forward and reverse current which information is sufficient to ensure safe operation of the burner. This approach is so pervasive that usually there is not even recognition that a reverse current exists. The presence of a reverse current typically is not at issue because the forward current is much larger. Some control approaches even use the value of the average current as an indication of degradation of the flame sensor, but not to derive additional information about the flame.

SUMMARY OF THE INVENTION

A general object of the present invention is to provide an apparatus and method for quantitatively measuring electrical characteristics of the flame utilizing a current rod sensor and deriving information regarding the chemistry of the flame from resistive measurements.

These and other objectives are satisfied by a flame sensor which has first and second electrodes for passing an electric current through the flame. An alternating current source connected to the first and second electrodes and includes a for pulse width modulator for varying the duty cycle of the alternating current which flows through the flame. A controller is coupled to the pulse width modulator and alters the duty cycle of the alternating current so that the average current through the flame is zero.

The present invention utilizes the concept that if duty-cycle of generated alternating current can be adjusted to supply zero average current through the flame, then the duty-cycle will be related to the ratio of the forward flame resistance to the reverse flame resistance. In addition, if the positive voltage period is inversely related to the magnitude of the forward current and the negative voltage period to the magnitude of the reverse current, and forward and reverse voltages are equal, the forward resistance will be directly proportional to the positive voltage period and the reverse resistance to the negative voltage period. This enables the positive and negative voltage periods of the alternating current to be measured and used as an indicator of the flame chemistry.

DETAILED DESCRIPTION OF THE INVENTION

Figure 1:
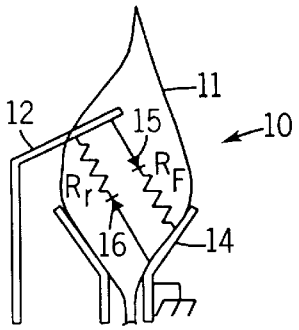
FIG. 1 is a schematic representation of the sensor current path through the burner flame.
Figure 2:
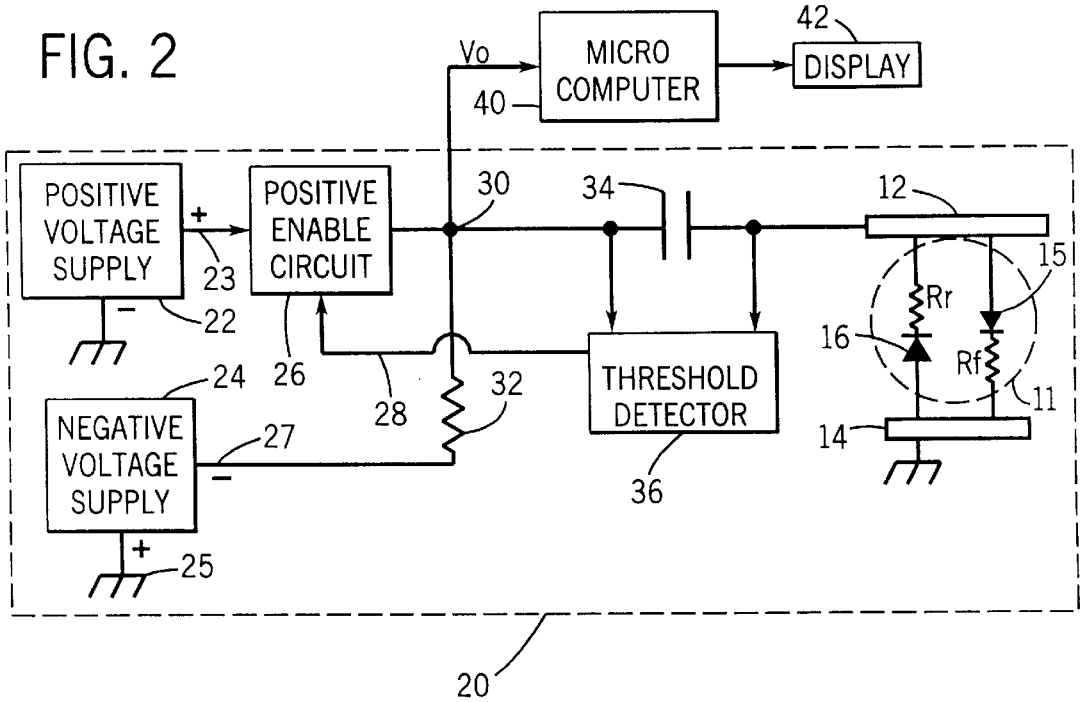
PRIOR ART FIG. 2
FIG. 2 is a block schematic diagram of the sensor circuitry for producing an output signal containing flame information for analysis.

With initial reference to FIG. 2 the present sensor circuit 20 includes a positive voltage supply 22 and a negative voltage supply 24. The output voltages produced by both power supplies 22 and 24 are referenced with respect to circuit ground 25 and preferably those voltages are identical, 30 volts for example. The positive voltage supply 22 has a positive terminal 23 and a negative terminal connected to ground. The negative voltage supply 24 has a positive terminal connected to ground 25 and a negative terminal 27.

The positive terminal 23 of the positive voltage supply 22 is connected to a positive enable circuit 26 which, when activated by a signal on line 28, connects that positive terminal to an output node 30. The negative terminal of the negative voltage supply 24 is coupled by load resistor 32 to the output node 30. The voltage at output node 30 is coupled by a current integrating capacitor 34 to the flame sensor rod 12. A threshold detector 36 receives samples of the voltage present across the capacitor 34 and utilizes that voltage to produce the signal on line 28 which controls the positive enable circuit 26. Thus the threshold detector 36 acts as a controller for the positive enable circuit.

The control circuit in FIG. 2 has a set of relatively simple direct current power supplies 22 and 24 connected together through a load resistance so that when the enable circuit 26 controlling the positive voltage is off and the output voltage applied to flame rod 12 is negative. Otherwise when the enable circuit 26 controlling the positive voltage is on the positive supply voltage is applied to the flame rod 12. The selected power supply 22 or 24 is coupled through the capacitor 34 to the flame 11.

The threshold detector 36 is a very high impedance circuit with a sharp voltage threshold characteristic and hysteresis. The threshold detector 36 activates the positive enable circuit 26 when the voltage across capacitor 34 is above a predefined threshold (i.e. is more positive than the threshold). This activation of the positive enable circuit 26 couples the output of the positive voltage supply 22 through output node 30 to the current integrating capacitor 34. When the capacitor voltage goes below this threshold, the positive enable circuit 26 is deactivated, thereby decoupling the positive voltage supply from output node 30 and the capacitor 34. The positive voltage supply 22 remains decoupled until the capacitor voltage drops below the threshold minus the hysteresis of the threshold detector 36 at which point the positive supply voltage is again coupled by the positive enable circuit 26.

This sensor circuit 20 is in a static negative output condition until a load is connected to the capacitor 34. That is until a flame 11 is present. A negative current flow through the reverse flame diode 15 charges the capacitor 34 in the positive direction with respect to the threshold detector 36 until the threshold is reached. Thereafter the polarity of the current reverses and the capacitor 34 begins to discharge back to the lower hysteresis threshold. At that point, the polarity reverses again toward a positive state completing the cycle. If the average current is zero the waveform of the resultant signal across the capacitor 34 will be a function of the resistive characteristics of the flame.

Figure 3:
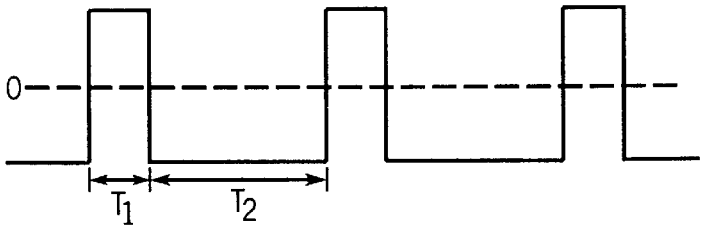
FIG. 3 is a balanced charge (zero average current) waveform applied to the sensor rod by the circuit in FIG. 2.

The present invention utilizes the concept that if an alternating polarity, pulse-width modulated waveform of the flame current can be generated so that the duty-cycle is adjusted to supply zero average current through the flame, then the duty-cycle will be related to the ratio of the forward resistance to the reverse resistance. In addition, if the positive voltage period can be inversely related to the magnitude of the forward current and the negative voltage period to the magnitude of the reverse current, and positive and negative voltages are equal, the forward resistance will be directly proportional to the positive voltage period and the reverse resistance to the negative voltage period. An example of this waveform is shown in FIG. 3 in this case $T_1=K/I_f$ and $T_2=K/I_R$. Where K is a constant and $I_f$ is the forward flame current and $I_R$ is the reverse flame current. Therefore if $T_2/T_1=I_f/I_r$, then $T_2/T_1=R_r/R_f$ which is the flame impedance ratio (FIR). It is recognized that if the threshold of the voltage detector is significant compared to the supply voltages, either the supply voltages must be made slightly different for the equations to be true or, the processor will need to make a digital correction in the calculations.

The output voltage Vo produced at the output node 30 is applied to an input of a microcomputer 40 which executes a program that measures the positive and negative periods $T_1$ and $T_2$ of the output voltage cycle. Those measurements provide information regarding the chemistry of the flame which can be derived by an additional software routine executed by the microcomputer 40. The measurements of periods $T_1$ and $T_2$ and the resulting flame characteristic information can be displayed on a monitor 42 and made available electrically to a burner controller.

Figure 4:
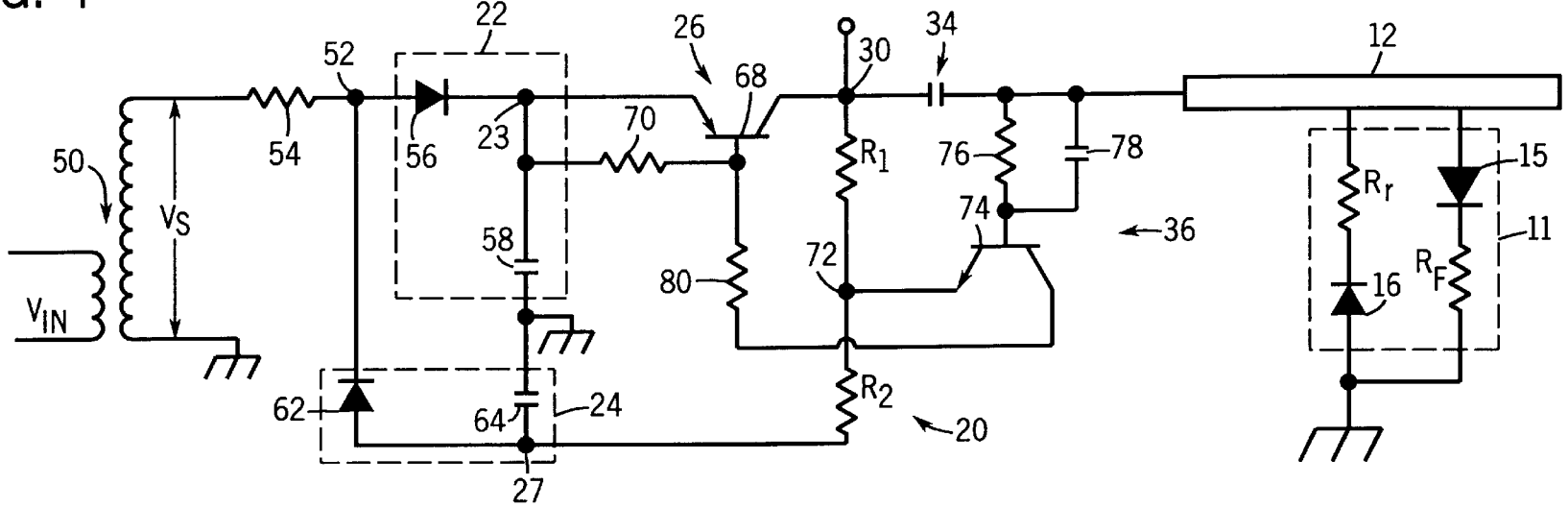
FIG. 4 is a detailed schematic diagram of the circuit in FIG. 2.

FIG. 4 shows one embodiment of the circuitry for the flame sensor 20. The power for the sensor circuit is derived from a transformer 50 which receives an alternating voltage Vin. The transformer 50 converts the input voltage to a desired AC supply voltage Vs which when rectified will produce the desired positive and negative supply voltages. One end of the secondary winding of transformer 50 is connected to circuit ground and the other end is coupled to a power supply node 52 by a current limiting resistor 54. The positive voltage supply 22 is formed by a first diode 56 and a first filter capacitor 58 connected in series between the power supply node 52 and circuit ground with the positive terminal 23 therebetween. The negative power supply 24 is formed by a second diode 62 and a second capacitor 64 connected in series between the power supply node 52 and circuit ground with negative terminal 27 therebetween.

The positive enable circuit 26 is implemented by a PNP first transistor 68 having an emitter connected directly to the positive terminal 23 and a base connected to the first positive output node by a bias resistor 70. The collector of the first transistor 68 is connected to output node 30.

The output of the negative voltage supply 24 at terminal 27 is applied through a voltage divider formed by resistors R1 and R2 to node output. An intermediate node 72 is formed between resistors R1 and R2.

Threshold detector 36 is formed by a second transistor 74 having an emitter connected directly to the intermediate node 72 of the voltage divider. The base of second transistor 74 is coupled to the flame rod 12 by resistor 76 and a third capacitor 78 connected in parallel. The collector of the second transistor 74 is coupled by resistor 80 to the base of the first transistor 68.

The normal starting condition for the sensor circuit 20 has no voltage applied to the base-emitter junction of the second transistor 74, thereby maintaining that transistor in a non-conductive state. At this time, the first transistor 68 also is nonconductive and the output voltage applied to the flame rod 12 is negative due to the coupling of the negative voltage supply 24 through resistors R1 and R2. As current begins to flow through the reverse flame resistance $R_r$, the current causes the current integrating capacitor 34 to charge. The capacitor 34 continues to charge until the voltage is sufficiently positive for the second transistor 74 to turn on. When the second transistor 74 becomes conductive, the first transistor 68 also will be turned on, thereby applying the positive voltage from the positive voltage supply 22 to output node 30. In this state of the circuit, current flows through the current integrating capacitor 34, the forward flame diode 15 and forward resistance Rf. This current flow begins to decrease the voltage on capacitor 34.

Noted that resistors R1 and R2 connect the negative voltage terminal 27 to the output node 30. A positive feedback circuit is formed by connecting the emitter of the second transistor 74 to the intermediate node 72 between resistors R1 and R2. This yields an effective hysteresis of the voltage drop across resistor R1. Preferably the design values yield a voltage hysteresis (Vh) of minus 0.35 volts. Once the positive voltage on current integrating capacitor 34 drops below the threshold voltage as modified by this hysteresis, the second transistor 74 turns off forcing the first transistor 68 also off. This disconnects the output of the positive voltage supply 22 from output node 30. As a result, the voltage at output node 30 goes negative due to the connection through resistors R1 and R2 to the output of the negative voltage supply 24. When this occurs the current integrating capacitor 34 starts to recharge due to the current conducted through the flame 11 in the reverse direction via reverse resistance $R_r$, thereby completing one cycle of the circuit operation. Capacitor 78 at the base of the second transistor 74 is employed to speed up the transition on the output waveform.

A result of this operation is that current integrating capacitor 34 charges through the negative flame resistance and discharges through the positive flame resistance. In each case, the charging continues until the voltage change is equal to the hysteresis voltage Vh. Specifically if the hysteresis voltage Vh is a total change in the voltage across the output capacitor 34, then $I_f$=C dv/dt=C Vh/$T_1$ and $T_1$=C Vh/$I_f$. Vh=2V(R1/R2) where V is the voltage produced by the negative voltage supply 24. By combining these equations one derives: $T_1$=(2C V/$I_f$) (R1/R2). When $I_f$=V/$R_f$, then $T_1$=2C $R_f$ (R1/R2). In this situation, the current integration capacitance C 34 and the values of resistors R1 and R2 are known, thereby providing a direct relationship between time $T_1$ and the forward flame resistance $R_f$.

The calculation of the flame impedance ratio ($R_r$/$R_f$) eliminates most of the sensor positioning and burner size effects. This is indicated by the fact that while a main burner has a much lower resistance than a pilot burner, both burners have a flame impedance ratio in the same range. This suggests that an estimate of the combustion gas mixture based on the flame impedance ratio could have an inherently better signal to noise ratio than other measurements which have only the differential current as the data point.

The foregoing description was primarily directed to a preferred embodiment of the invention. Although some attention is given to various alternatives within the scope of the invention, it is anticipated that one skilled in the art will likely realize additional alternatives that are now apparent from the disclosure of the embodiments of the invention. For example, it is not significant whether the threshold detector 36 utilizes a negative or a positive threshold and thus controls the application of either the positive or negative supply voltage to the output node 30. In addition, other types of transistors may be utilized. Accordingly, the scope of the invention should be determined from the following claims and not limited by the above disclosure. It is also recognized that the positive and negative supplies do not have to be approximately equal to make these measurements, only that the most direct relationship between the time and the flame resistance is available when the supplies are such that the positive and negative cycles are equal for a pure resistance load in place of the flame.

What is claimed is:

1. A sensor for detecting characteristics of a flame, said sensor comprising:

first and second electrodes for passing an electric current through the flame;

a source of current connected to the first and second electrodes and for producing an alternating current which flows through the flame wherein the alternating current is pulse-width modulated and has a duty cycle; and a controller coupled to the source of current to alter the duty cycle of the alternating current so that average current through the flame is zero.

2. The sensor as recited in claim 1 wherein the source of current comprises:

a first DC power supply having a first positive terminal and a first negative terminal, wherein the first negative terminal is connected to the second electrode;

a second DC power supply having a second positive terminal and a second negative terminal, wherein the second positive terminal is connected to the second electrode;

an output node;

a capacitor coupling the output node to the first electrode;

a switch circuit for selectively connecting one of the first positive terminal and the second negative terminal to the output node, in response to an enable signal; and a resistor coupling the other of the first positive terminal and the second negative terminal to the output node.

3. The sensor as recited in claim 2 wherein the switch circuit selectively connects the first positive terminal to the output node.

4. The sensor as recited in claim 2 wherein the controller comprises a threshold detector connected to the capacitor and to the switch circuit, the threshold detector producing the enable signal in response to the voltage across the capacitor having predefined relationship to a voltage threshold.

5. The sensor as recited in claim 4 wherein the threshold detector has hysteresis with respect to the voltage threshold.

6. The sensor as recited in claim 1 further comprising a circuit which measures a negative period and a positive period of the alternating current.

7. The sensor as recited in claim 6 further comprising a mechanism which derives a characteristic of the flame from the negative period and the positive period of the alternating current.

8. A sensor for detecting characteristics of a flame, said sensor comprising:

first and second electrodes for passing an electric current through the flame;

a first DC power supply having a first positive terminal and a first negative terminal, wherein the first negative terminal is connected to the second electrode;

a second DC power supply having a second positive terminal and a second negative terminal, wherein the second positive terminal is connected to the second electrode;

an output node;

a capacitor coupling the output node to the first electrode;

a switch circuit for selectively connected one of the first positive terminal and the second negative terminal to the output node, in response to an enable signal;

a resistor coupling the other of the first positive terminal and the second negative terminal to the output node;

a threshold detector connected to the capacitor and to the switch circuit, the threshold detector producing the enable signal in response to the voltage across the capacitor having predefined relationship to a voltage threshold.

9. The sensor as recited in claim 8 wherein the threshold detector has hysteresis with respect to the voltage threshold.

10. The sensor as recited in claim 8 further comprising circuit for measuring a negative period and a positive period of the alternating current.

11. The sensor as recited in claim 10 further comprising a mechanism which derives a characteristic of the flame from the negative period and the positive period of the alternating current.

* * * * *